United States Patent [19]

Munk et al.

[11] Patent Number: 4,699,812

[45] Date of Patent: Oct. 13, 1987

[54] IMPARTING STAIN RESISTANCE TO CERTAIN FIBERS

[75] Inventors: Stephen A. Munk, Chicago; Thomas P. Malloy, Lake Zurich, both of Ill.

[73] Assignee: Allied Corporation, Morristown, N.J.

[21] Appl. No.: 935,873

[22] Filed: Nov. 28, 1986

[51] Int. Cl.[4] ..... B05D 3/02

[52] U.S. Cl. ..... 427/393.4; 427/393.3; 427/389; 427/389.9; 428/96

[58] Field of Search ..... 427/393.4, 389, 393.3, 427/389.9; 428/96

[56] References Cited

U.S. PATENT DOCUMENTS

| | | | |
|---|---|---|---|
| 3,689,466 | 9/1972 | Bridgeford et al. | 260/79.3 |
| 4,501,592 | 2/1985 | Ucci et al. | 8/495 |
| 4,592,940 | 6/1986 | Blyth et al. | 428/96 |

*Primary Examiner*—Thurman K. Page
*Assistant Examiner*—L. R. Horne
*Attorney, Agent, or Firm*—Thomas K. McBride; John F. Spears, Jr.; Eugene I. Snyder

[57] ABSTRACT

Fibers containing free amino groups, and especially polyamide fibers, can be made resistant to certain stains, especially those resulting from food grade dyes, by contacting the fiber with a solution of an aliphatic sulfonic acid containing 8 to 24 carbon atoms. Branched chain aliphatic sulfonic acids are more effective than the linear aliphatic sulfonic acids, and branching at the carbon bearing the sulfonic acid group is more effective than branching at any other carbon. Contacting the fiber with the solution of the aliphatic sulfonic acid needs to be done under acidic conditions, most preferably at a pH between 0.5 to 5.0.

10 Claims, No Drawings

IMPARTING STAIN RESISTANCE TO CERTAIN FIBERS

BACKGROUND OF THE INVENTION

It is somewhat ironic that contemporary technology provides materials, such as carpets, which need replacement not because the fabric wears out, but because the fabric becomes stained to the point of being unsightly. Contemporary technology makes available extremely wear-resistant fabrics; contemporary technology also makes available such items as colored food drinks directed to a class of users (young children) whose nature virtually assures repeated spillage. The combination of these advances has spawned the need for making fabrics more resistant to staining; we want to create an "invisible barrier" on fabrics to various dyes.

As will be described in greater detail within, the fabrics of greatest pertinence to our invention are polyamides, and methods of increasing their stain resistance have been described. Some methods employ additives to reduce the wettability of the material. Other additives appear to coat and impregnate the fibers of the finished product, which increases their period of anti-stain effectiveness, and chief among the latter are aromatic sulfonic acids and, perhaps, sulfones. For example, a mixture of condensation products of formaldehyde with phenolsulfones, phenolsulfonic acids, and phenolsulfone sulfonic acids are used for nylon (polyamide) carpets, where relatively high molecular weight materials appear to be most efficacious when used alone (U.S. Pat. No. 4,592,940) and lower molecular weight materials are desirable only in the presence of alkali metal silicates (U.S. Pat. No. 4,501,591).

There are several disadvantages to the use of aromatic sulfonic acids as stain resistant agents. The major concern is their photoinstability which leads to their yellowing and thereby imparting a yellow cast on materials which have been treated with these sulfonic acids. Another, indirect concern is an environmental one. The process by which such sulfonic acids are made afford a plethora of products, some of which are or may be environmentally hazardous according to EPA standards. Thus there is a need for anti-staining agents which do not suffer from the above disadvantages.

The teaching of Bridgeford (U.S. Pat. No. 3,689,466) of polymeric alcohol sulfonic acids containing S-xanthogenate ester substituents as anti-staining agents appears to be singular with respect to non-aromatic sulfonic acids. A fair summary of the prior art is that anti-staining agents are most desirably aromatic sulfonic acids containing a substantial amount of sulfones and of high molecular weight unless used in conjunction with an alkali metal silicate as an additive, and that where a non-aromatic sulfonic acid is used it is as a high molecular weight polymeric material where the S-xanthogenate moiety is an integral and indispensable part of the anti-stain agent.

Our invention is the use of simple, relatively low molecular weight aliphatic sulfonic acids as agents which impart stain resistance to fabrics containing free amino groups. The aliphatic sulfonic acids which are used as stain resistant agents in this invention are environmentally safe, are biodegradable, and are prepared without environmental hazards. The aliphatic sulfonic acids of our invention are effective at relatively low levels and are effective without the presence of additives. Our stain resistant agents are non-yellowing, are inexpensive, are readily available in the marketplace, and are easy to apply.

SUMMARY OF THE INVENTION

The purpose of this invention is to make amino-containing fibers more resistant to certain stains. An embodiment comprises contacting such fibers with a solution of an aliphatic sulfonic acid at an acid pH. In a more specific embodiment the fiber is a polyamide. In a still more specific embodiment the aliphatic sulfonic acid is a branched alkyl sulfonic acid containing from about 8 to about 20 carbon atoms. In a still more specific embodiment the fibers are treated with the aliphatic sulfonic acids of this invention at a pH between about 0.5 and 5.0. Other purposes and embodiments will be apparent from the ensuing description.

DESCRIPTION OF THE INVENTION

As stated above, the purpose of this invention is to impart stain resistance to certain fibers. We have accomplished this by coating and impregnating fibers with aliphatic sulfonic acids, which we have found to substantially increase the resistance of such fabrics to staining by many common dyes, especially those used in foodstuffs.

The fibers to which the materials of our invention impart stain resistance are fibers containing free amino groups. Chief among these fibers are polyamides, i.e., nylons. Other fibers to which the materials of this invention can impart stain resistance include wool and silk.

The process for imparting stain resistance to fibers containing free amino groups involves merely contacting such fibers with a solution of an aliphatic sulfonic acid, which is the active anti-staining agent. Such aliphatic sulfonic acids may be either an alkyl ($C_nH_{2n+1}$) or an alkenyl ($C_nH_{2n-1}$), i.e., monounsaturated paraffinic, sulfonic acid. Whether an alkyl or alkenyl sulfonic acid those of this invention contain from about 8 to about 24 carbon atoms, and those containing from 8 to about 20 carbon atoms are particularly preferred in the practice of our invention. The aliphatic sulfonic acids may be either linear or branched sulfonic acids, and in fact it is quite desirable to have branching in the alkyl or alkenyl portion to increase lipophilicity. Especially desired is branching at the carbon bearing the sulfonic acid moiety, that is, secondary alkyl and alkenyl sulfonic acids are preferred species. Where the aliphatic portion is an alkenyl group the site of unsaturation is not important to the success of our invention and may occur anywhere along the carbon chain.

Examples of alkyl groups which may be used in the sulfonic acids of this invention include, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, and tetracosyl groups. The alkenyl groups which may be used are the monounsaturated analogs of those above, that is, octenyl, nonenyl, decenyl, undecenyl, etc.

Illustrative of the aliphatic sulfonic acids are 1-octane sulfonic acid, 1-nonane sulfonic acid, 1-decane sulfonic acid, 1-undecane sulfonic acid, 1-dodecane sulfonic acid, etc., as exemplary of the linear or unbranched alkyl sulfonic acids. To illustrate the branched alkyl sulfonic acids one can mention 2-octane sulfonic acid, 3-octane sulfonic acid, 4-octane sulfonic acid, 5,5-dimethyl-2-hexane sulfonic acid, 5,6,7-trimethyl-3-dodecane sulfonic acid, 4,6,9,10-tetramethyl-2-undecane sulfonic acid, 4,6,9,10-tetramethyl-3-undecane sulfonic acid, etc. Exemplary of the alkenyl sulfonic acids are such materials as 2-dodecene-1-sulfonic acid, 3-dodecene-1-sulfonic acid, 4-dodecene-1-sulfonic acid, 11-dodecene-1-sulfonic acid, 4-dodecene-2-sulfonic acid, 11-dodecene-3-sulfonic acid, 11-dodecene-5-sulfonic acid, 10-methyl-10-undecene-1-sulfonic acid, 10-methyl-10-undecene-2-sulfonic acid, 8,9-dimethyl-9-decene-1-sulfonic acid, 5,5-dimethyl-7-decene-1-sulfonic acid, etc.

One also may use cycloaliphatic sulfonic acids in the practice of this invention, especially cyclopentane and cyclohexane sulfonic acids where the ring is substituted with one or more alkyl groups so as to give a total carbon content between 8 and 24. Additionally, one can have any chemically unreactive substituent on the aliphatic or cycloaliphatic portion, especially those with the potential of lowering surface energy. The halogens, and particularly fluorine, are desirable substituents.

The fibers are then contacted with a solution of an aliphatic sulfonic acid in an amount sufficient to impart stain resistance to the fibers. An aqueous solution is most desirable to minimize environmental difficulties, because water is the most convenient solvent to use, and because it is the most inexpensive. However, this requires that the aliphatic sulfonic acid be soluble to an extent of between about 0.1 and about 2.0 weight-weight percent at the temperature of treatment. It needs to be understood that the use of an aqueous solution is not mandatory to the success of this invention and where other considerations dictate the use of a different solvent this is not at all detrimental to the practice of our invention, although it may not necessarily lead to equivalent results. What we wish to emphasize is that nonaqueous or only partially aqueous solutions may be used in the practice of this invention, especially where the solubility of the sulfonic acid is inadequate to afford the requisite aqueous solutions, or where other considerations, for whatever reasons, dictate the use of a solvent other than water.

The treatment bath generally contains between about 2 and about 40% of sulfonic acid based on the weight of the fiber, and it has been found that a bath containing between about 4 and about 8% on the weight of fiber is most useful. Where the treatment bath is used in a weight ratio of 20:1 to fiber, this translates to aqueous solutions containing between about 0.1 and about 2.0 weight-weight percent aliphatic sulfonic acid.

The pH at which the treatment of the fiber with the aqueous solution of the aliphatic sulfonic acid is performed is found to have an important effect on the resulting stain resistance. In particular, it is necessary for the treatment of the fibers to be conducted at an acid pH, most desirably in the pH range from about 0.5 to about 5.0, with even more effective results being obtained when the pH is between about 1.5 and about 3.0. The temperature at which the fibers are contacted with the aqueous solution of the aliphatic sulfonic acid is not critical to the success of this invention but may affect the contact time. Thus, the treatment temperature may be in the range between about 15° C. and the boiling point of the solution, i.e., ca. 100° C., with contact time decreasing with increasing temperature. It has been found that a treatment temperature between about 35° and about 65° affords a good compromise.

The treatment time may depend on the particular sulfonic acid used, its concentration, and the treatment temperature. Where 20 parts of aqueous solution are used per part (by weight) of fabric at a 4–8% sulfonic acid on the weight of the fabric and at 50° C., the treatment time is on the order of about 15 minutes.

Stain resistance may be conferred by treating the fiber, the yarn, or the fabric made from fibers or yarns. Stain resistance may be conferred either upon the finished article or at some earlier manufacturing step. Where the fabric is acid dyed the fabric must be treated after being dyed. But the fabric may be treated to impart stain resistance before being dyed when other dye methods are used, e.g., disperse dying. Thus, the treatment is susceptible to a number of variations whose effectiveness may be similar, and the following only exemplify various methods of treatment.

In one variant the fibers are agitated while immersed in a bath which is a solution containing aliphatic sulfonic acids at a concentration sufficient to provide between about 2 and about 40% acids on the weight of the fiber. Frequently about 20 parts by weight solution is used per weight of fabric, although this ratio is not at all critical and can be adjusted up or down to suit the operation being performed, the manufacturing procedures, etc. The pH of the solution will be between about 0.5 and 5.0, and more effectively will be in the range between 1.5 and 3.0. Where the bath temperature is on the order of 50° C. a treatment time of about 15 minutes suffices. After the fabrics have been immersed in the treatment solution for a sufficient time, they are removed and excess solution is removed by passing the fabric through one or more rollers. The moist fibers then can be air dried at ambient temperature or dried at an elevated temperature in, for example, a hot air tunnel. In a subvariant the fabric can be treated not by immersion in a bath of the aliphatic sulfonic acid, but rather by having a solution of the anti-stain agent sprayed on the fiber as the latter is conveyed past a spraying zone.

In another variant stain resistance may be conferred at a manufacturing stage prior to the finished product, such as is often done in carpet manufacture. In particular, the article may be treated with a solution of an aliphatic sulfonic acid during or immediately subsequent to the dyeing stage, as for example is described in U.S. Pat. No. 4,501,591.

In yet another variation the dyed product may be treated. Using carpets as an example of a product to which this invention is directed, the finished dyed product may be immersed in a bath of sulfonic acid or the solution of sulfonic acid may be sprayed onto the carpet. Excess solution is removed and the carpet is dried as described above.

The following examples are only illustrative of this invention. It is not intended that our invention be limited to or by these examples.

EXAMPLE I

This description shows a method of treatment of polyamide fibers which results in conferring stain resistance to said fibers. Four tenths of a gram of an aliphatic sulfonic acid with a carbon atom content in the range of from $C_{14}$ to $C_{17}$ (Hostapur SAS 93, manufactured by Hoechst) was dissolved in 185 mL of deionized tap water and the pH was adjusted to 2 with 10% sulfuric acid. After the resultant solution was diluted to 200 mL and warmed to 50° C., 10.0 g of a woven nylon 6 fiber sleeve was vigorously agitated mechanically in the solution for 15 minutes. Excess liquid was removed by patting dry the sleeve with paper towels and the sleeve was oven-dried for 30 minutes at 110° C. The treated nylon sleeve was then used for stain testing as well as for wash tests in the following examples.

EXAMPLE II

A nylon sleeve prepared as above was placed between the open mouth of a 20 mL vial containing 2 mL of a soft drink solution containing the acid dye FD&C red #40, and a 5.5 cm diameter petrie dish. While holding these items in intimate physical contact, the vial was inverted and vigorously agitated for five minutes so as to continuously contact the nylon sleeve with the acid dye solution. Subsequently, as much stain as possible was removed from the nylon sleeve through contact with dry towels followed by contact with wet towels. An untreated nylon sleeve was subjected to the same conditions as above to provide a reference for stain comparison. There was a very dark red stain on the untreated fiber while the treated fiber was a very light pink stain.

These sleeves also were examined by transmission ultraviolet spectroscopy on an SLM-Aminco DW 2C UV-VIS Spectrophotometer at a wavelength of 510 nanometers. Plain, untreated, unstained nylon sleeves gave an absorbance of 0.000; stained and untreated nylon sleeves gave an absorbance of 0.750; stained and treated nylon sleeves gave an absorbance of 0.078. These data indicate that the anti-stain agents reduced staining by the FD&C red #40 acidic dye by about 90%.

EXAMPLE III

This experiment was performed to illustrate the washfastness of the anti-stain agents added to the nylon fiber as in Example I. A nylon sleeve treated as in Example I was vigorously agitated for 15 minutes at 50° C. in a detergent solution comprising 200 mL of deionized water containing 0.20 g of sodium dodecylbenzenesulfonate (Stepan Naconol 90-F), 0.20 g of polyethyleneglycol paraisooctylphenylether (Rohm & Haas Triton-X-100), and adjusted to a pH of 9.5 utilizing trisodium phosphate. After rinsing in deionized water for 30 seconds, drying with paper towels, and drying in an oven at 110° C. for 30 minutes, the nylon sleeve was stained as in Example II. The nylon sleeve showed similar anti-stain properties as an unwashed, pretreated sample thereby indicating that the stain resistance remains after washing.

EXAMPLE IV

This example was carried out to illustrate the applicability of the anti-stain agents of this invention to prevention of staining of nylon by other dyes contained in soft drink preparations. The nylon sleeves were pretreated as in Example I and stained as in Example II but the soft drink mixtures contained FD&C dyes yellow #6 and blue #1. In each case the untreated nylon stained to a greater extent than did the pretreated nylon as determined visually. Stain resistance of treated material was judged to be excellent, with an even more effective barrier against these stains than FD&C red #40.

EXAMPLE V

This experiment was carried out to compare the behaviour of different alkyl sulfonates when used as anti-stain agents for nylon fiber. The procedures of Examples I and II were followed in this comparison and the alkyl sulfonates used were a $C_8$ sodium-1-octane sulfonate, a $C_{12}$ alkane sulfonate, a $C_{15}$ alkane sulfonate, and a $C_{14}$–$C_{16}$ mixture of alpha-alkene sulfonates, i.e., the product mixture resulting from sulfonation of a mixture of $C_{14}$–$C_{16}$ terminal olefins (1-alkenes). The visual results, summarized in Table 1, indicated that a longer alkyl group on the sulfonate provided more anti-stain protection than a shorter alkyl group.

TABLE 1

Variation of Stain Resistance with Chain Length

| Chain Length | Stain Resistance | Water Solubility (0.2% weight-weight) |
|---|---|---|
| 8 | good | miscible |
| 12 | excellent | turbid at room temperature; soluble at 50° C. |
| 16 | excellent+ | turbid at room temperature and 50° C. |

These data show that increasing the chain length of the sulfonic acid improves its stain resistance but decreases its water solubility.

EXAMPLE VI

This experiment was carried out to observe the protection afforded to the nylon when the amount of sulfonate available by weight in the solution of Example I was varied. Nylon sleeves were treated as in Example I but varying quantities of the alkyl sulfonate were utilized to afford solutions of 2, 4, 8, and 40% by weight based on the weight of fiber used. These treated nylon fiber sleeves were then stained as in Example II and the resultant products compared as to anti-stain properties. This comparison indicated that as the amount of alkyl sulfonate available in solution increased the anti-stain properties also increased for the treated nylon, although it appeared that the 8% loading was equal in preventative ability to the 40% loading.

EXAMPLE VII

A nylon sleeve was treated as described in Example I except that the sulfonic acid solution was adjusted to pH 3.8. The treated sleeve was then stained with FD&C red #40 as described in Example II. Visual examination showed some improvement in stain resistance, but far less than at pH 2.

What is claimed is:

1. A process for imparting stain resistance to fibers selected from the group consisting of polyamide, wool and silk fibers containing free amino groups in an article manufactured from such fibers comprising contacting the fibers with a solution of an aliphatic sulfonic acid containing from about 8 to about 24 carbon atoms in an amount sufficient to impart stain resistance to the fibers at a pH between about 0.5 and about 5.0 and a temperature from about 15 to about 100° C., and thereafter drying the fibers.

2. The process of claim 1 where the fiber is a polyamide.

3. The process of claim 1 where the sulfonic acid is an alkyl or alkenyl sulfonic acid.

4. The process of claim 3 where the sulfonic acid contains from 8 to about 20 carbon atoms.

5. The process of claim 3 where the alkyl or alkenyl is a branched chain moiety.

6. The process of claim 5 where branching is at the carbon bearing the sulfonic acid moiety.

7. The process of claim 1 where the sulfonic acid is a cycloaliphatic sulfonic acid.

8. The process of claim 1 where the cyclic portion is a cyclopentane or cyclohexane ring.

9. The process of claim 1 where the pH is between about 1.5 and about 3.0.

10. The process of claim 1 where the temperature is between about 35° and about 65° C.

* * * * *